US006637812B2

(12) United States Patent
Laughlin et al.

(10) Patent No.: US 6,637,812 B2
(45) Date of Patent: Oct. 28, 2003

(54) FOLDING READY-TO-ASSEMBLE UPHOLSTERED FURNITURE

(76) Inventors: Glenn M. Laughlin, 3331 Earnhardt Rd., Sophia, NC (US) 27350; Jeffrey A. Frank, 6429 Kenhowe Dr., Bethesda, MD (US) 20817

( * ) Notice: Subject to any disclaimer, the term of this patent is extended or adjusted under 35 U.S.C. 154(b) by 0 days.

(21) Appl. No.: 10/105,292

(22) Filed: Mar. 26, 2002

(65) Prior Publication Data

US 2002/0105211 A1 Aug. 8, 2002

Related U.S. Application Data

(63) Continuation-in-part of application No. 09/825,863, filed on Apr. 5, 2001.

(60) Provisional application No. 60/194,862, filed on Apr. 6, 2000.

(51) Int. Cl.[7] ..... A47C 4/00

(52) U.S. Cl. ..... 297/36; 297/35; 297/37; 297/118

(58) Field of Search ..... 297/35, 36, 37, 297/2, 1, 118, 117, 111, 105, 411.3, 411.32, 116, 440.1, 440.15, 17, 217.1, 283.3, DIG. 6, 129; 5/55.1, 45

(56) References Cited

U.S. PATENT DOCUMENTS

| | | | | | |
|---|---|---|---|---|---|
| 477,421 | A | * | 6/1892 | Jaekel | 297/116 |
| 803,826 | A | * | 11/1905 | Holmes et al. | 5/26.1 |
| 863,874 | A | * | 8/1907 | Rajner | 297/105 |
| 1,424,302 | A | * | 8/1922 | Helms | 297/184.11 |
| 1,855,130 | A | * | 4/1932 | Appleby | 297/21 |
| 2,217,426 | A | * | 10/1940 | Zareko | 297/117 |
| 2,452,642 | A | * | 11/1948 | Ewing | 297/116 |
| 2,531,045 | A | * | 11/1950 | Hoffman | 297/117 |
| 4,234,976 | A | | 11/1980 | Litkewycz | |
| 4,632,459 | A | | 12/1986 | Herschlag | |
| 4,697,847 | A | | 10/1987 | Herschlag | |
| 4,848,839 | A | * | 7/1989 | Galardo | 5/12.2 |
| 5,263,764 | A | | 11/1993 | Laughlin | |
| 5,329,654 | A | | 7/1994 | Sherman | |
| 5,394,573 | A | | 3/1995 | Laughlin | |
| 5,423,596 | A | * | 6/1995 | Laughlin et al. | 297/440.1 |
| 5,551,757 | A | | 9/1996 | Glover | |
| 5,678,897 | A | | 10/1997 | Prestia | |

* cited by examiner

*Primary Examiner*—Peter M. Cuomo
*Assistant Examiner*—Erika Garrett

(57) ABSTRACT

An upholstered foldable furniture system having a first assembled configuration for seating and a second unassembled configuration for storage and shipping. The furniture system has a horizontal seat support frame having front and rear support frame members, spaced left and right side support frame members, a back member having a bottom back member rotatably secured to the rear support frame member and left and right back side support members. The back member is rotatable between a position substantially parallel to the horizontal seat support frame and an angle of not less than 90° with respect to the horizontal seat support frame. Left and right arm members are provided, each having a rear arm frame and a lower arm frame. The left and right lower arm frames are secured to the left and right side support frame members respectively. The furniture system also provides left and right latch assemblies. When the furniture system is in the first assembled configuration for seating, the back member is in a substantially vertical position, the left and right arm members are in substantially vertically upward positions, and the left and right latch assemblies are latched. When the furniture system is in the second unassembled configuration for storage and shipping, the back member is in a substantially horizontal position, and the left and right latch assemblies are unlatched.

20 Claims, 14 Drawing Sheets

FOLDING READY-TO-ASSEMBLE UPHOLSTERED FURNITURE

BACKGROUND OF THE INVENTION

This is a continuation-in part-application claiming the benefit of Provisional Application No. 60/194,862, filed Apr. 6, 2000 and Non-provisional application No. 09/825,863, filed Apr. 5, 2001.

This invention relates to furniture, and in particular, to folding ready-to-assemble fully upholstered furniture that can be shipped and/or stored in a relatively small space.

Fully upholstered furniture, such as sofas, loveseats, chairs and sleep sofas that do not have exposed frame members, tend to be large, bulky and heavy. Fully upholstered furniture has also gradually increased in size over the past two decades and does not always fit through narrow doorways or staircases in many older homes and apartments.

It is known to provide upholstered furniture that is assembled by the consumer. Although such Knockdown or Ready-to-Assemble (RTA) upholstered furniture reduces shipping costs and fits into narrow spaces, its commercial popularity has been limited. Fully upholstered RTA furniture can be more costly than comparable conventional furniture due in part to the need for expensive hardware and the use of expensive fabrics to cover areas that remain hidden in conventional designs. Also, it has been found that assembly of such furniture can be awkward for customers who lack the physical strength needed to assemble heavy components. It is also known to provide RTA futon furniture. Typically, this type of furniture is not fully upholstered and consists of an exposed wood or metal frame with one or more futon cushions.

It is also known to provide furniture that is foldable, for example, folding lawn chairs or desk chairs. Typically, this type of furniture is used outdoors as lawn or beach furniture, or as office or institutional-type seating. This folding furniture is typically not fully upholstered, and often has exposed unsightly hardware, and thus, is not suitable for use in most homes as living room or family room seating. Further, it is known to provide fully upholstered foam furniture (that does not utilize wood frames or spring supports) for family room use. However, such furniture can be relatively uncomfortable, lack durability, and be unsuitable for most in-home uses. It is also known to provide fully upholstered automotive seating, which is not suitable for living room or family room seating.

SUMMARY OF THE INVENTION

It is an object of the present invention to provide fully upholstered furniture items that are foldable so as to require reduced space for transport or storage; are as sturdy and durable as conventional upholstered furniture; are indistinguishable in styling and comfort from conventional fully upholstered furniture; are simple to assemble, and are relatively inexpensive to manufacture.

Another object of the invention is to provide attachment systems that will securely attach the arms and back of the upholstered furniture item to a frame so that there will be minimal wracking or separation between components, and yet will allow various parts to be folded or removed for storage or shipping. Wracking is defined as a twisting movement that often occurs between the arms and back of inexpensive upholstered furniture.

Still another object of the invention is to provide fully upholstered furniture items that do not require a rail to determine the pitch angle between the back and seat. Further, the furniture items do not require an outer back member to maintain the pitch angle, as is the case of conventional upholstered furniture. In this invention, proper pitch is maintained through the use of a combination of latches fixing the angle of the back of the arms, and the back frame member.

It is also an object of the present invention to provide a fully upholstered furniture item that may be rapidly and completely assembled by a single consumer; and that in use has no exposed hardware and no separate parts or hardware that may get lost in transportation or storage.

It is another object of the present invention to provide a new, original and ornamental design of a fully upholstered, foldable, furniture item.

The above and other objects are accomplished by providing a foldable, fully upholstered, furniture item for placement on a substantially horizontal surface. The furniture system has a horizontal seat support frame having front and rear support frame members, spaced left and right side support frame members, a back member having a bottom back member rotatably secured to the rear support frame member and left and right back side support members. The back member is rotatable between a position substantially parallel to the horizontal seat support frame and an obtuse angle with respect to the horizontal seat support frame. Left and right arm members are provided, each having a rear arm frame and a lower arm frame. The left and right lower arm frames are secured to the left and right side support frame members respectively. The furniture system also provides left and right latch assemblies. When the furniture system is in a first assembled configuration for seating, the back member is in a substantially vertical position, the left and right arm members are in substantially vertically upward positions, and the left and right latch assemblies are latched. When the furniture system is in a second unassembled configuration for storage and shipping, the back member is in a substantially horizontal position, and the left and right latch assemblies are unlatched.

The latching assembly can be a generic draw catch, window latch or similar catch, latch or clamp intended to join a pair of members in abutting relationship along the edges thereof and to lock them in place. The latching assemblies may be manually released to allow the arm and back members to pivot about their respective horizontal axis to the storage configuration.

In this first embodiment, the latching assembly is reinforced by a hook and loop fastener (such as VELCRO®) comprised of a hook element and al loop element. VELCRO®is a trademark registered by Velcro Industries. B.V. for hook and loop fasteners. The hook and loop elements are brought together during the assembly process, allowing the latching elements to be easily aligned. After the latching elements are locked in place, and a person is seated, the hook and loop fasteners prevent the back member from pivoting on a horizontal axis away from the storage configuration by resistance across the horizontal plane of the hook and loop fastener.

Preferably, the seat member is pivotably connected to the various support members using a plurality of respective hinges. The hinges can be continuous, i.e., extending across the entire width of the furniture item, or alternatively, two or more separate hinges can be used to connect each arm and back member to the seat member. The hinges may be comprised of metal, plastic, or a fabric material. Whether the present invention is folded in the storage configuration or unfolded in the normal seating configuration, little weight is placed on the hinges.

Further, instead of hinges, the various support members can be pivotably attached to the seat member using other means, for example, a ball-and-socket arrangement. Regardless of the method of pivotably attaching the arm and back members to the seat member, it will be appreciated that this connection retains the various support members in constant connection with the seat member, so that the various components cannot become lost or separated.

This embodiment provides for a furniture item that is easily set up by a single person merely by pivoting out light weight arm and back members. The assembly process requires no tools, special skills, and little strength. Moreover, the furniture item can be unfolded and locked into the correct seating position by an individual purchaser in a matter of seconds. Further, when folded in the storage position, (with the seat and back cushions stored beneath the seat member) the furniture item displaces only 50% to 75% of the space occupied by the assembled item (depending upon the style.) As such, the furniture item according to the present invention can be easily and inexpensively transported and stored.

An alternative embodiment provides for a furniture item in which the arms are bolted to the seat member. As in the previous embodiment, the furniture item further includes right and left latching assemblies, each consisting of two elements, a latch member and a receptacle member. These latch members lock together to further restrict movement of the arm members and to prevent the back member from pivoting on its axis. In addition, the positioning of the right and left latching assemblies determines the angle of the back member thereby setting the pitch of the back member in relation to the seat member. Although this embodiment requires additional time for assembly, it has the advantage of reducing the size of the item in storage or when being shipped.

An additional embodiment provides for a furniture item in which a sleeper mechanism is substituted for the seat member springs shown in the previously described embodiments. This sleeper mechanism can be a generic model such as those manufactured by Leggett & Platt.

The present invention thus provides for upholstered furniture such as a chair, sofa or sleep sofa that is decorative, aesthetically pleasing, comfortable, and usable in most homes.

The invention will now be described in greater detail in connection with embodiments thereof that is are illustrated in the drawing figures.

DETAILED DESCRIPTION OF THE INVENTION

The following description describes sofas embodying the invention, but it will be understood that it is equally applicable to chairs, sleepers and other types of upholstered furniture. In the description, the terms "vertical" and "horizontal" refer to directions substantially perpendicular and parallel, respectively, to a floor on which the chair or other type of furniture is placed. Also the described sofa is symmetrical; therefore for clarity, some of the drawings show only the left hand components as viewed from the front of the sofa, the right hand components being mirror images of the left hand components. In general, the left hand components are identified by unprimed numbers, and the right hand components, whether illustrated or not, are identified by primed numbers.

Figure 1:
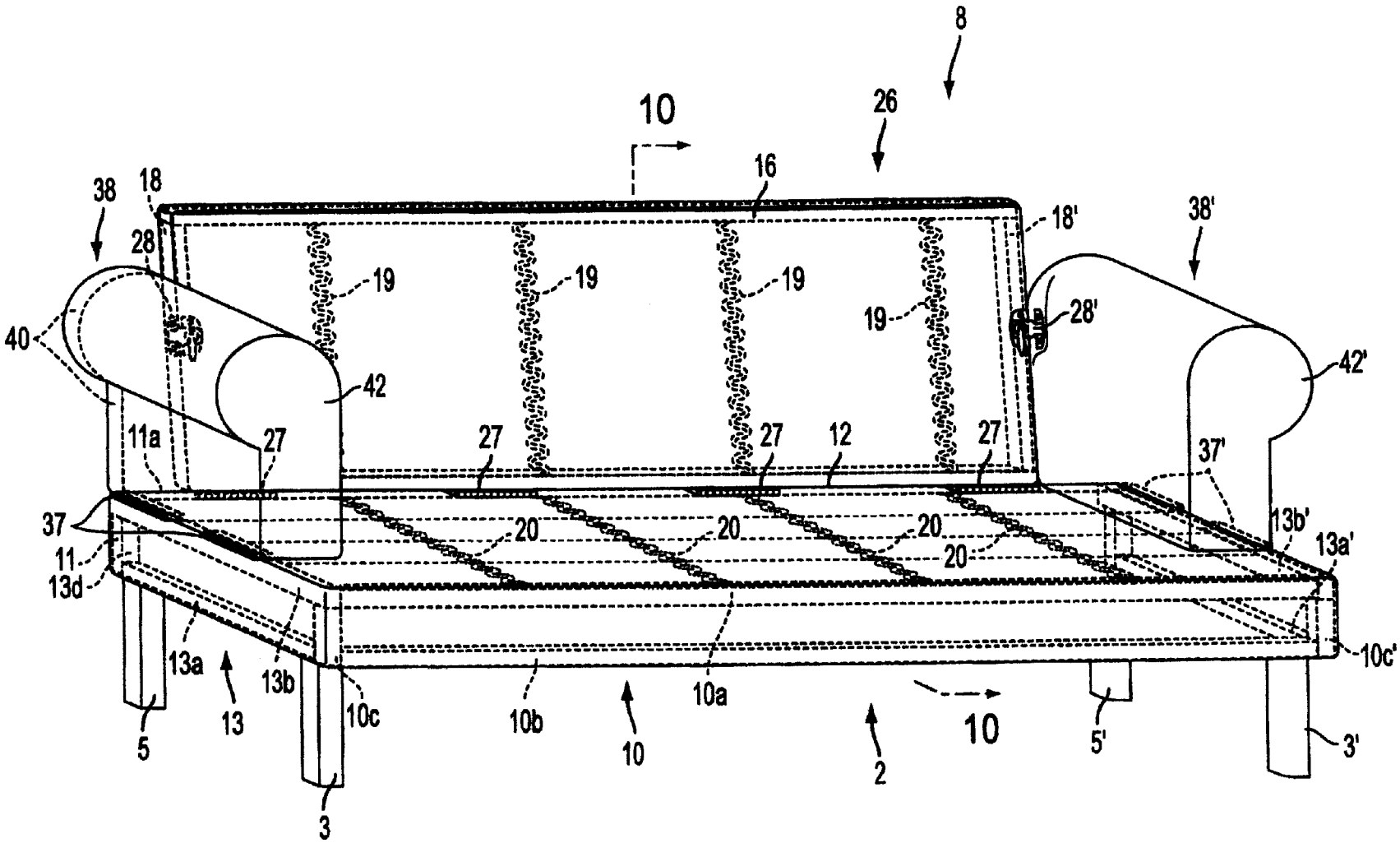
FIG. 1 is a perspective illustration of a furniture item according to a first embodiment of the present invention shown in its unfolded seating configuration without seat or back cushions.
Figure 2:
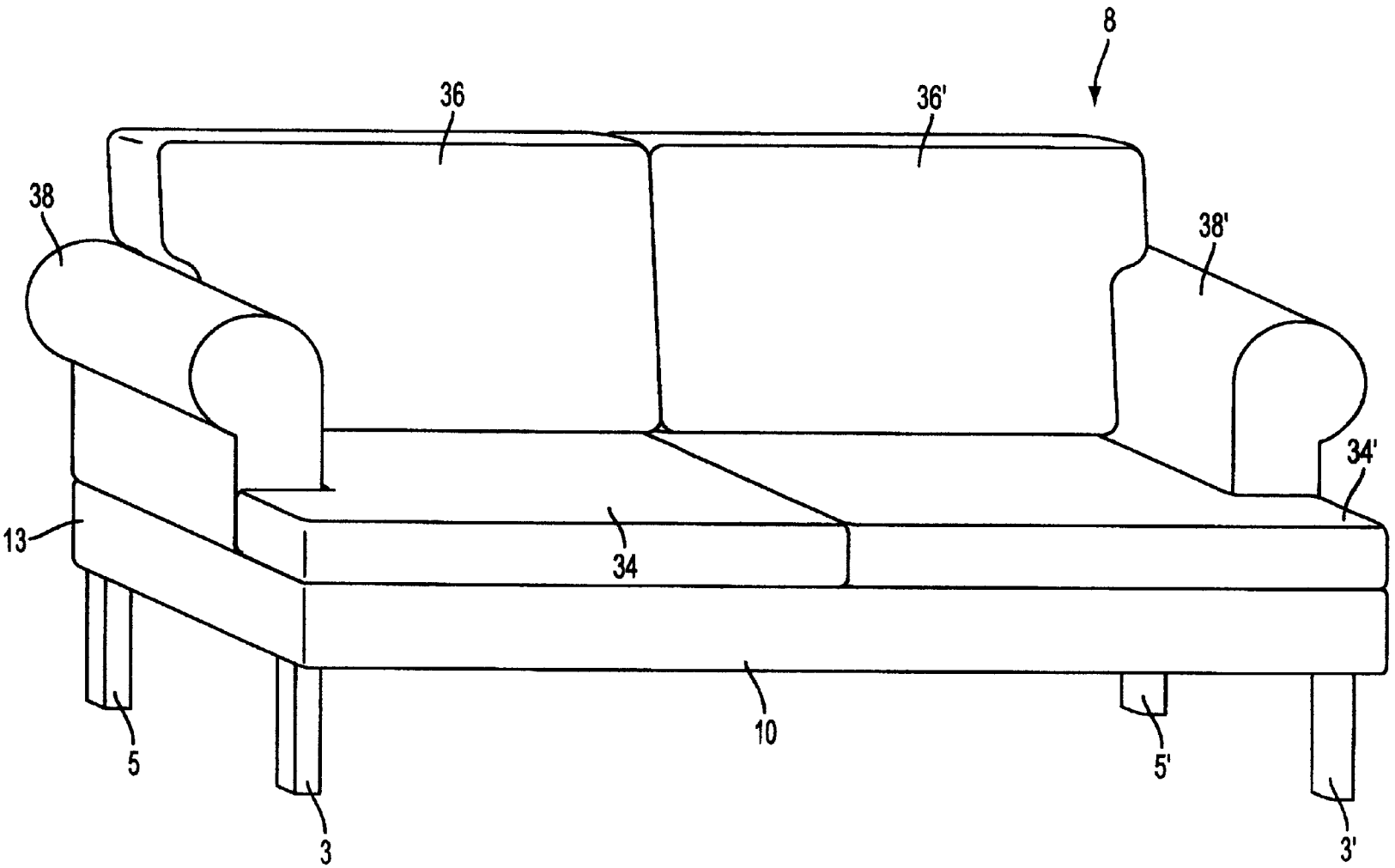
FIG. 2 is a perspective illustration of the present invention shown in its unfolded seating configuration with upholstery and cushions.

Referring to FIGS. 1 and 2, the first embodiment of the unfolded furniture item in the normal seating configuration is illustrated. In particular, this embodiment shows the furniture item as being a sofa 8. When unfolded, the sofa 8 is comprised of a seat support frame 2, a back member 26, arm members 38, 38', and legs 3, 3', 5, 5'.

Figure 4:
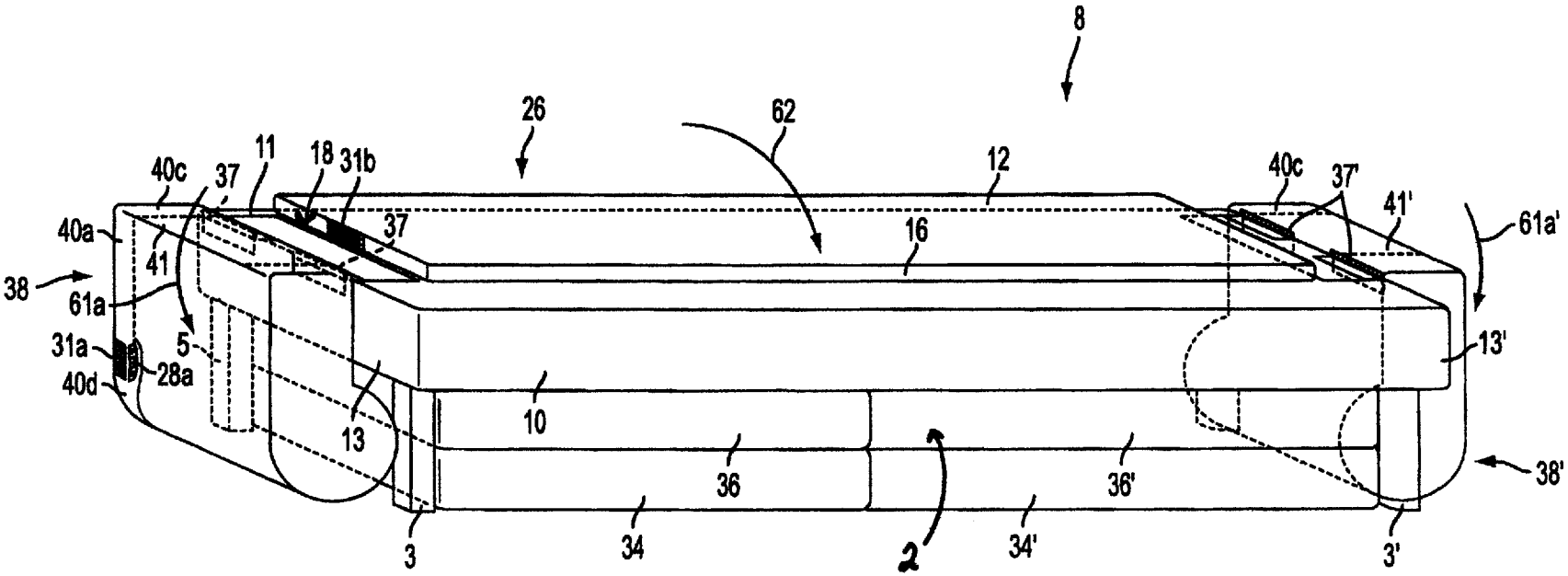
FIG. 4 is a perspective front view of the first embodiment showing the furniture item in the folded storage or shipping configuration, with cushions stored beneath the seating platform.

Referring to FIG. 4, an embodiment of the folded furniture item in the storage or shipping configuration is illustrated.

The seat support frame 2 is comprised of horizontal front and rear spaced support frame members 10, 11 joined to horizontal left and right side support frame members 13, 13'. A seat support unit 20 (FIG. 1) is located within the seat support frame 2 bounded by support frame members 10, 11, 13, 13' and is attached to front and rear support frame members 10, 11. Alternatively, the seat support unit 20 could be attached to side support frame members 13, 13'. The seat support unit may be comprised of sinuous springs (as shown), coil springs, webbing, a sleeper unit, or other conventional seat support means.

Figure 9:
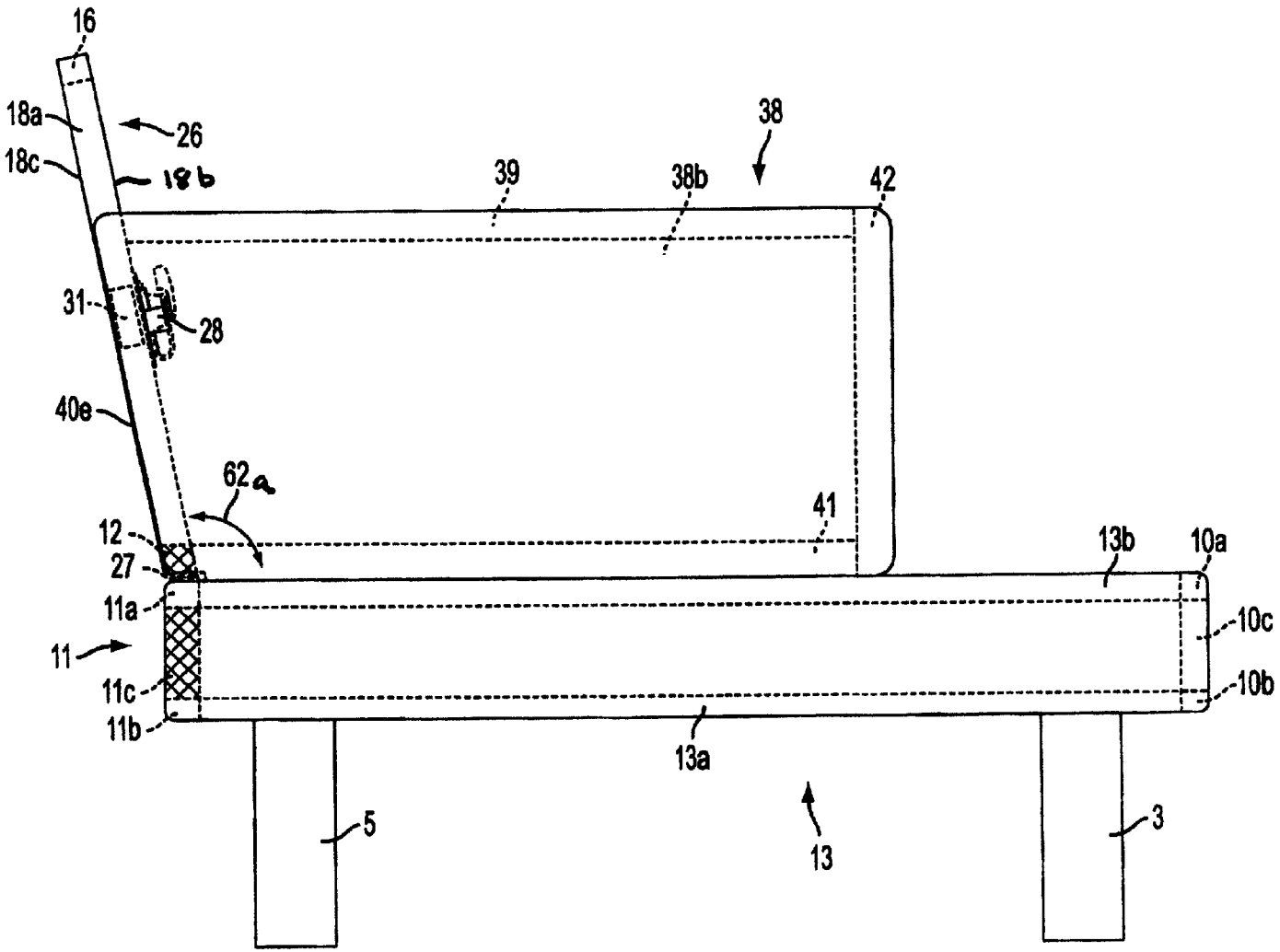
FIG. 9 is a left side view of the first embodiment shown in FIG. 1 in its unfolded seating configuration.
Figure 10:
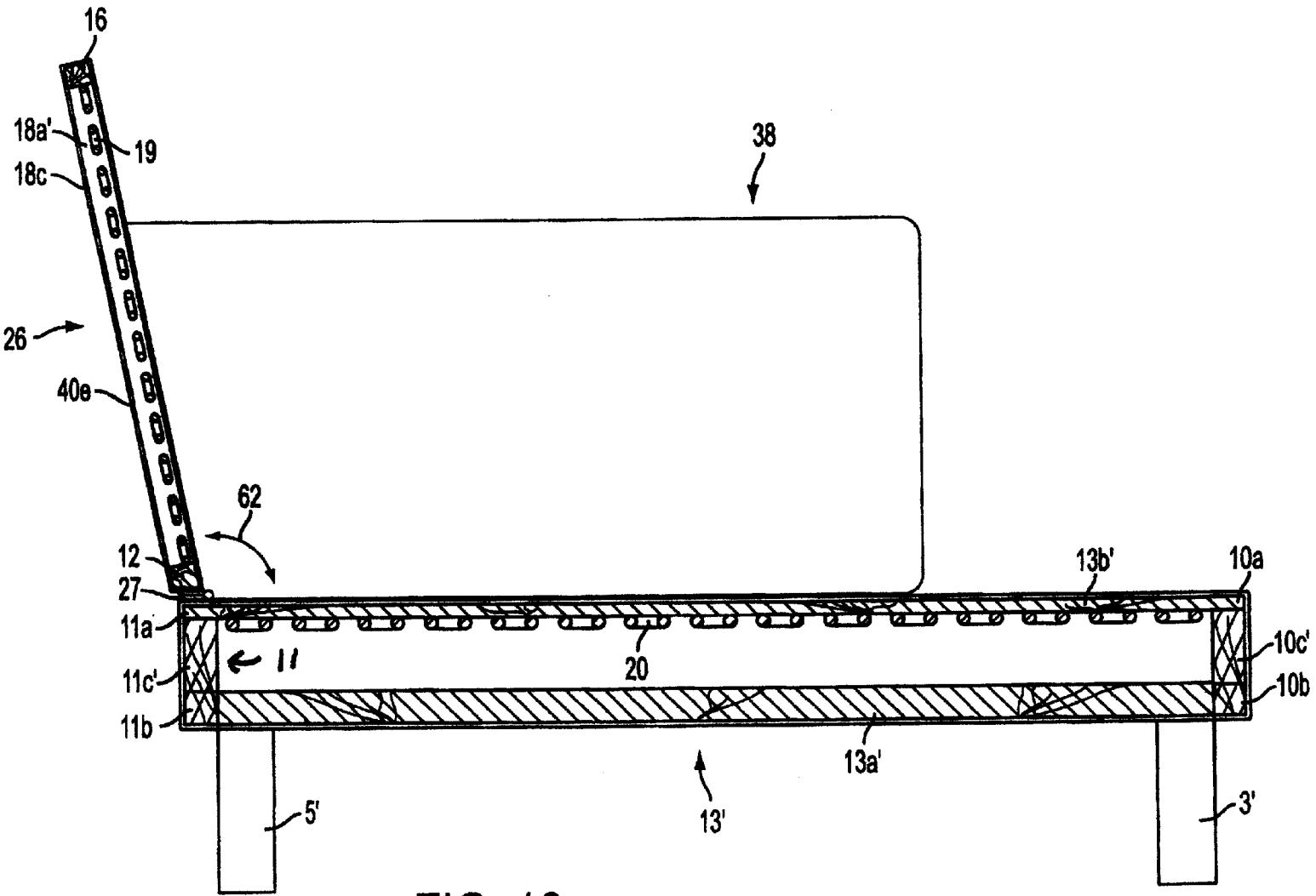
FIG. 10 is a cross section side view of the first embodiment taken along the line 10—10 of FIG. 1.

As best shown in FIGS. 9 and 10, front support frame member 10 is comprised of an upper front support frame member 10*a*, a lower front support frame member 10*b*, and side front support frame members 10*c*, 10*c*'. Rear support frame member 11 is comprised of an upper rear support frame member 11*a*, a lower rear support frame member 11*b*, and side rear support frame members 11*c*, 11*c*'. Side support frame members 13, 13' are comprised of lower side support frame members 13*a*, 13*a*' and upper side support frame members 13*b*, 13*b*'. Lower side support frame members 13*a*, 13*a*' are attached to lower front and rear support frame members 10*b*, 11*b* respectively. Upper side support frame members 13*b*, 13*b*' are attached to upper front and rear support frame members 10*a*, 11*a* respectively.

Figure 5:
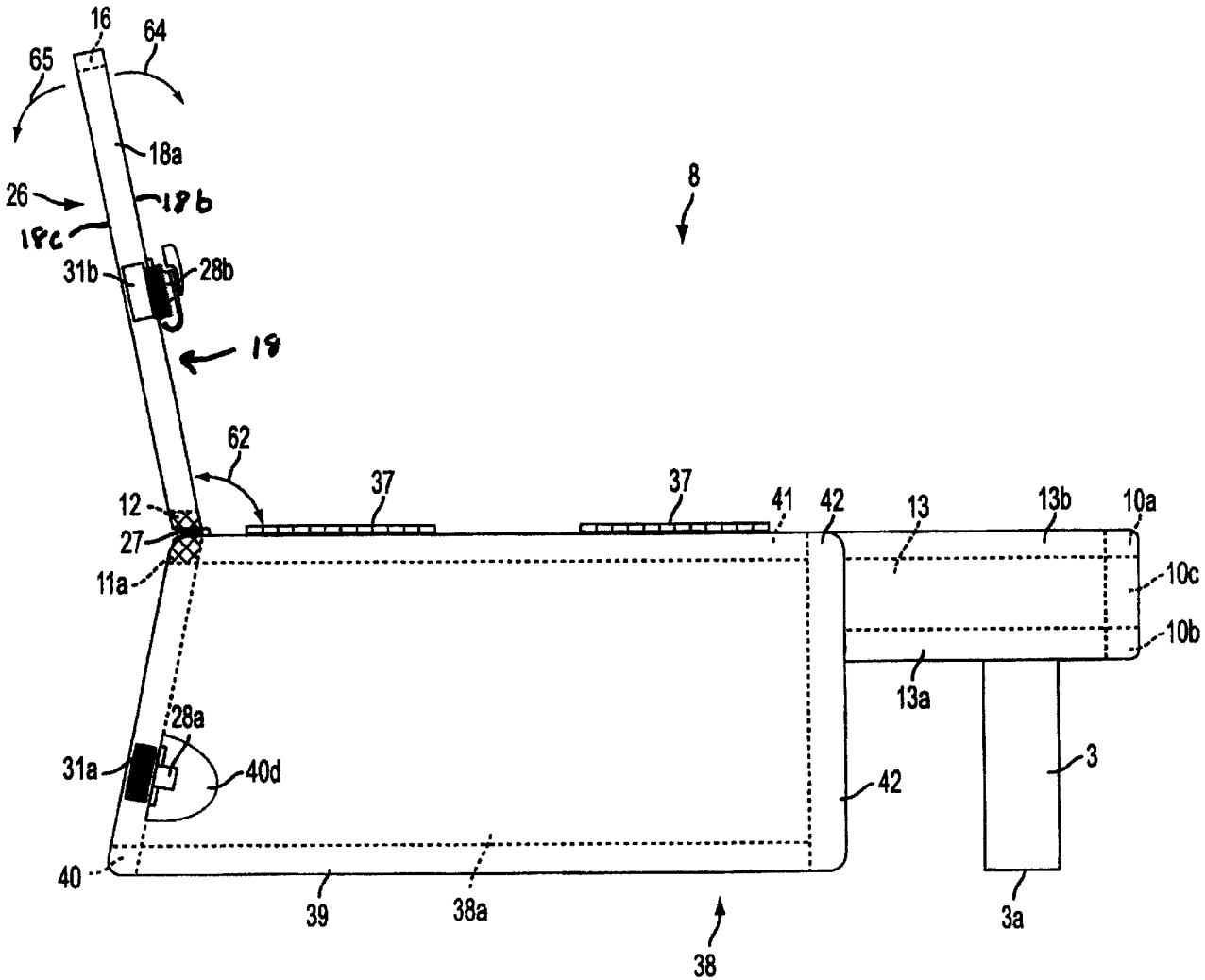
FIG. 5 is a left side view of the first embodiment shown in FIG. 1 in a partially folded position.

As shown in FIGS. 1 and 4, the back member 26 is comprised of vertically spaced apart bottom back member 12 and top back member 16, and vertical left and right spaced apart back side support members 18, 18'. Bottom back member 12 is attached to rear support frame member 11 by a plurality of rear hinges 27 (or a continuous hinge.) As shown in FIG. 3A, when unfolded, and as typical with sofas, the back member 26 and the rear support frame member 11 are essentially disposed linearly relative to one another. However, for comfort reasons the back member 26 is usually arranged at a slight angle relative to the rear support frame member 11 (FIG. 5). A back support unit 19 (FIG. 1) is located within the frame bounded by members 12, 16, 18, 18' and is attached to top and bottom back members 16, 12. The back support unit 19 may be comprised of sinuous springs (as shown), coil springs, fabric, webbing, or other conventional back support means.

Figure 3B:
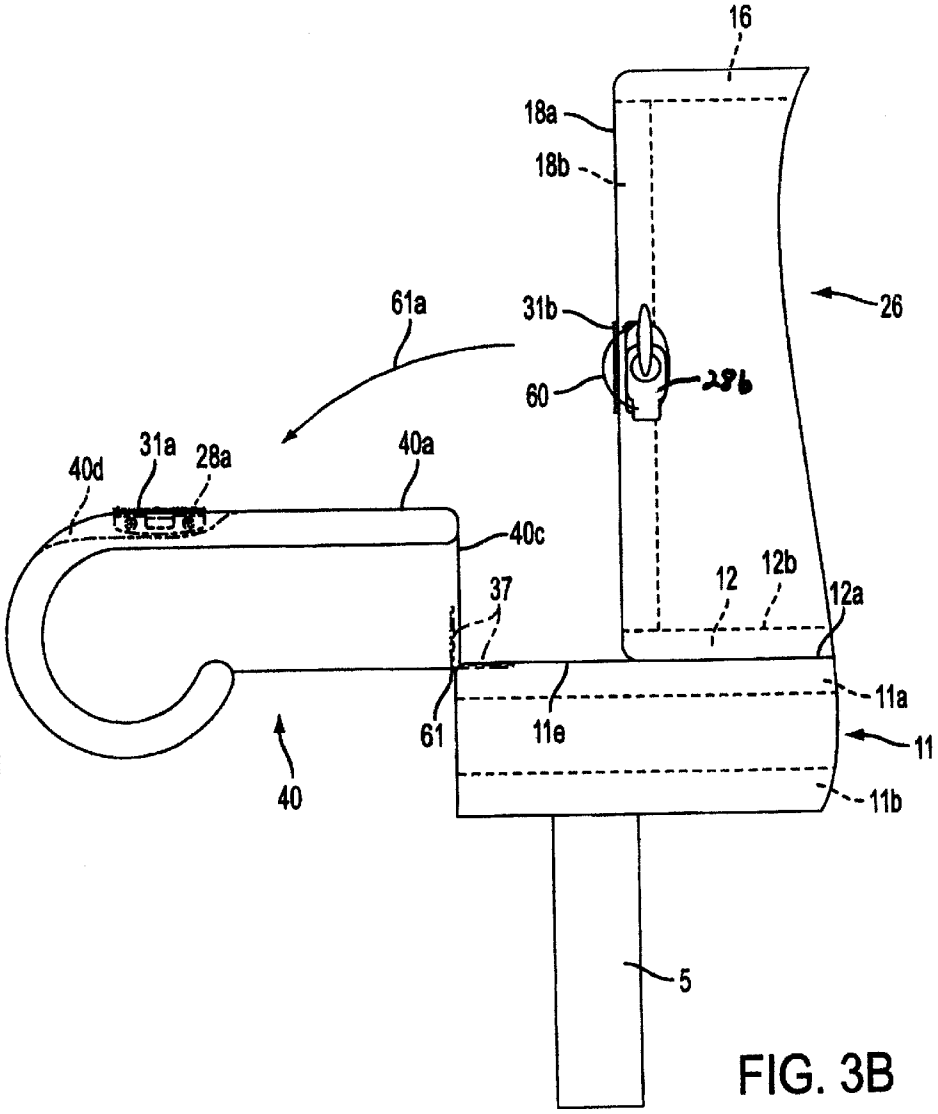
FIGS. 3A, 3B and 3C are partial perspective front views of the first embodiment of the invention looking toward the left arm member and showing the left arm rear frame member including the left latching assembly, back member and rear support frame member.
Figure 3A:
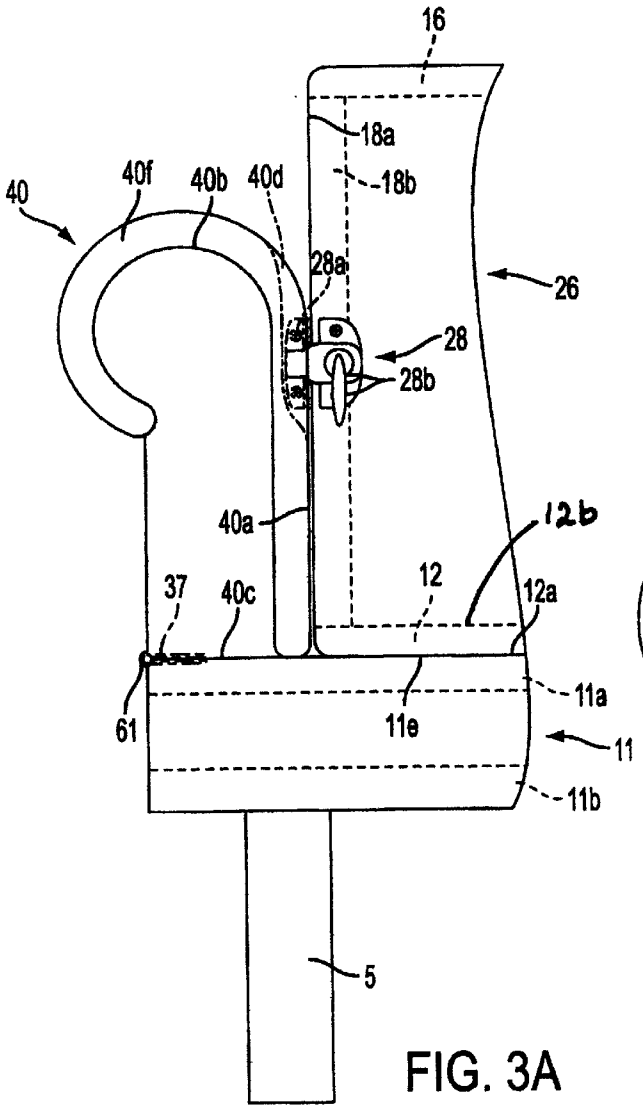
Figure 3C:
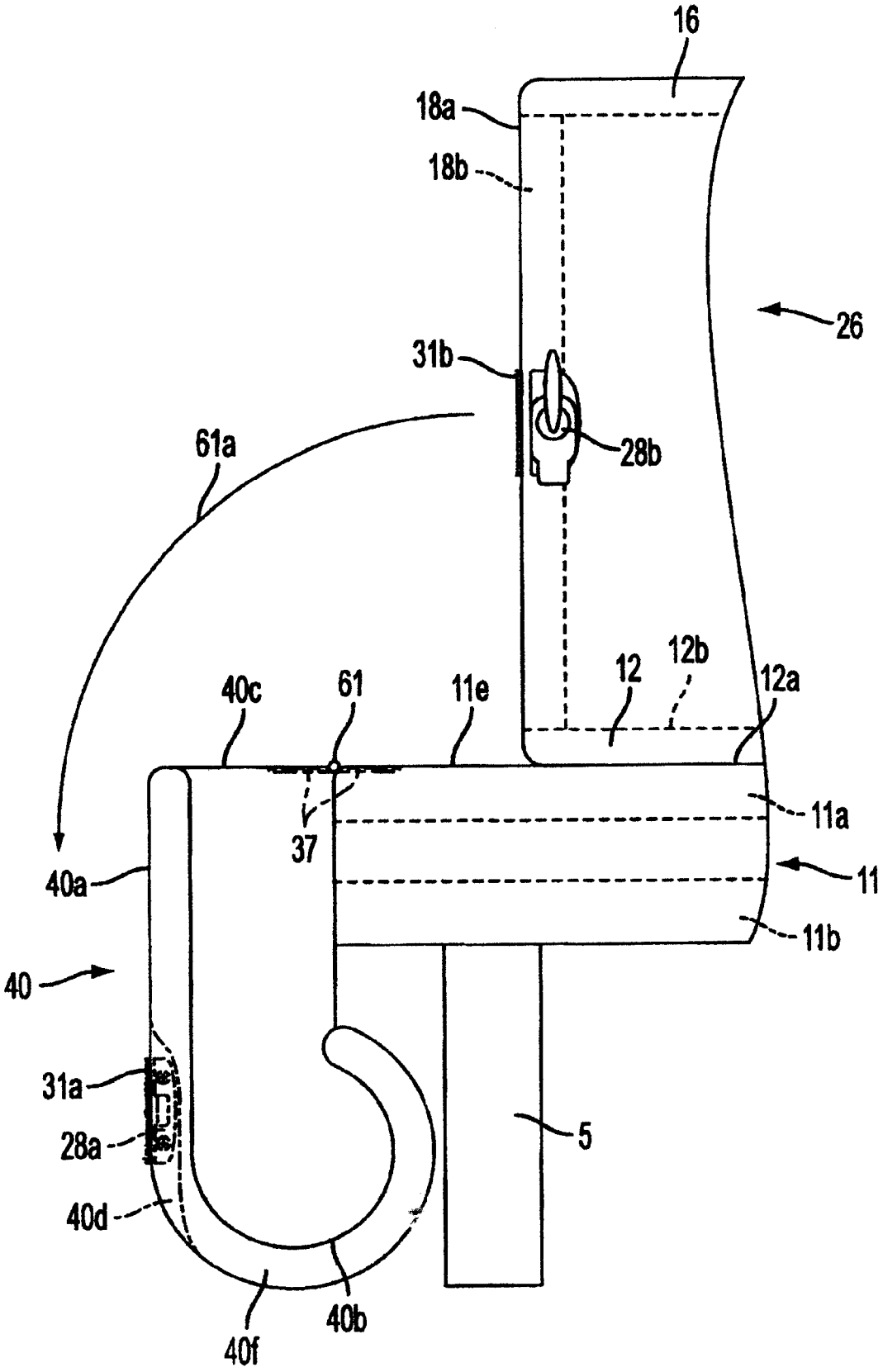

As shown in FIGS. 3A, 3B and 3C, bottom back member 12 includes bottom surface 12*a*, and top surface 12*b*. Bottom back member 12 is rotatably connected by rear hinges 27 (FIG. 5) to upper rear support frame member 11*a*. Left and right back side support members 18, 18' include side surfaces 18*a*, 18*a*', front surfaces 18*b*, 18*b*', and rear surfaces 18*c*, 18*c*' (FIG. 9).

As best shown in FIGS. 1, 5 and 9 the arm members 38, 38' are comprised of front arm frames 42, 42', rear arm frames 40, 40', lower arm frames 41, 41' and upper arm frames 39, 39'. Left and right arm members 38, 38' are attached to side support frame members 13, 13' by means of a plurality of side hinges 37, 37' (or continuous hinges). In the folded storage position (FIGS. 3C and 4), arm members 38, 38' fold outwardly to rest against or in close proximity to front legs 3, 3' and rear legs 5, 5'.

As shown in FIGS. 3A, 3B and 3C, rear arm frames 40, 40' include inside surfaces 40*a*, 40*a*', top surfaces 40*b*, 40*b*', bottom surfaces 40*c*, 40*c*', front surfaces 40*d*, 40*d*', rear surfaces 40*e* and 40*e*' (FIG. 9) and upholstered coverings 40*f*, 40*f*'.

As shown in FIG. 4, when upholstered in the folded, storage and shipping configuration, seat and back cushions 34, 34', 36, 36' fit below the support frame members 10, 11, 13, 13'.

Referring to FIGS. 3A, 3B and 3C, the inside surfaces 40*a*, 40*a*' of rear arm frames 40, 40' are removably connected to side surface 18*a*, 18*a*' of back side support members 18, 18' of back member 26 by means of latch assemblies 28, 28' composed of receptacle members 28*a*, 28*a*' and latch members 28*b*, 28*b*'. The inside surfaces 40*a*, 40*a*' of rear arm frames 40, 40' are also removably connected to side surfaces 18*a*, 18*a*' of back side support members 18, 18' of back member 26 by means of hook and loop fasteners 31, 31' comprised of loop elements 31*a*, 31*a*' and hook elements 31*b*, 31*b*'. (FIGS. 3B and 3C). FIGS. 3A and 9 show the relative positions of arm member 38 and back member 26 in the attached position. Bottom surfaces 40*c*, 40*c*' of rear arm frames 40, 40' rest on a top surface 11*e* of rear support frame member 11. FIG. 3B shows the relative positions of arm member 38 and back member 26 midway through the pivot of arm member 38 along axis 61 to the folded position. FIGS. 3C and 5 show the relative positions of arm member 38 and back member 26 in the folded (storage or shipping) position. Bottom surfaces 40*c*, 40*c*' of rear arm members 40, 40' are contiguous with the top surface 11*e* of rear support frame member 11, and lower arm frames 41, 41' of arm members 38, 38' (FIGS. 5 and 6) are contiguous with the top surfaces of upper side support frame members 13*b*, 13*b*' of side support frame members 13, 13'.

Figures 6, 7, 8:
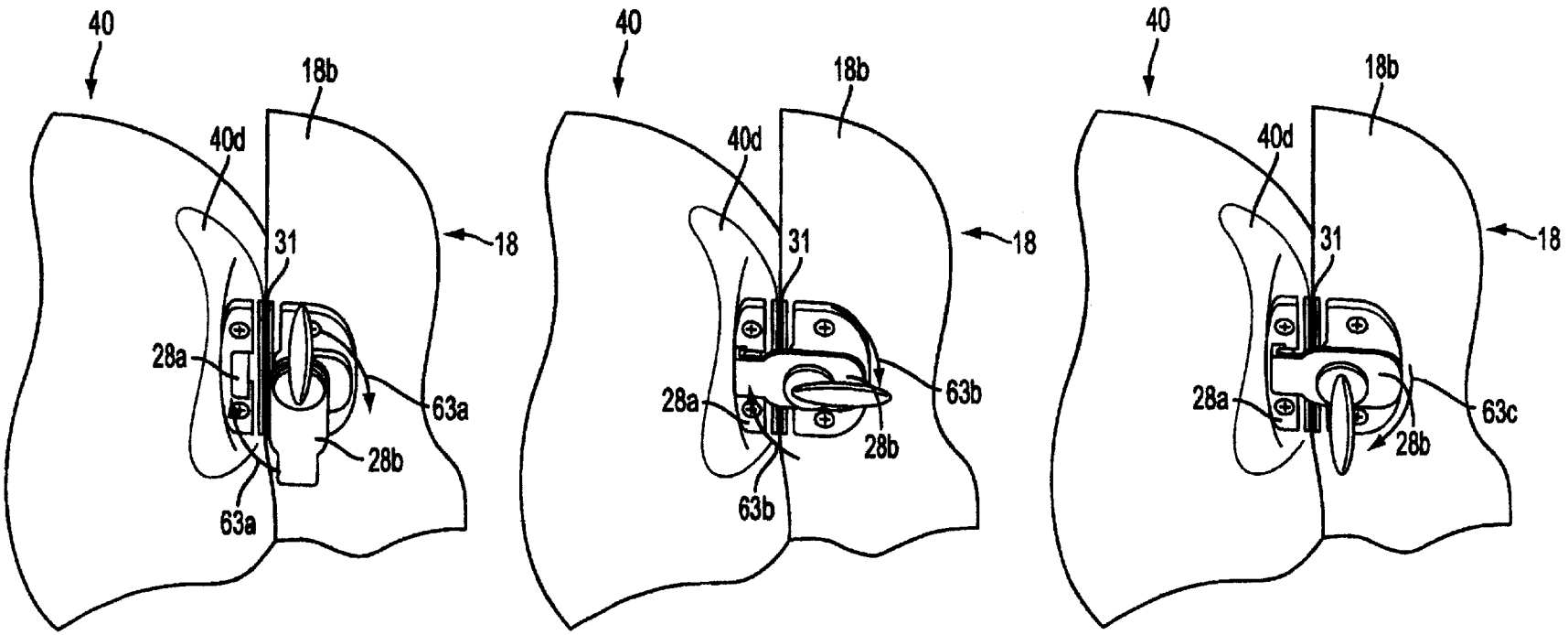
FIG. 6 is a perspective front view of the locking mechanism component of the latching assembly in the unlatched position.
FIG. 7 is a perspective front view of the locking mechanism component of the latching assembly in the latched, but unlocked position.
FIG. 8 is a perspective front view of the locking mechanism component of the latching assembly in the latched and locked position.

As can be seen in FIGS. 3A, 3B, 3C, 6, 7 and 8, the latch members 28*b*, 28*b*' are attached to front surfaces 18*b*, 18*b*' of left and right back side support members 18, 18'. The receptacle members 28*a*, 28*a*' are attached to front surfaces 40*d*, 40*d*' of rear arm frames 40, 40'. The hook elements 31*b*, 31*b*' are attached to side surfaces 18*a*, 18*a*' adjacent to latch members 28*b*, 28*b*' respectively. The loop elements 31*a*, 31*a*' are attached to side surfaces 40*a*, 40*a*' adjacent to receptacle members 28*a*, 28*a*' respectively. As seen in FIGS. 6, 7 and 8, as the latch member 28*b* is rotated in the direction of arrows 63*a*, 63*b*, and 63*c*, it hooks receptacle member 28*a* (FIG. 7), pulling the back member 26 and rear arm frame 40 together, then locking them into place (FIGS. 3A, 8), thus preventing horizontal movement of the arms members 38, 38' around pivot point 61 along the axis described by arrow 61*a*. This locking action also joins hook elements 31*b*, 31*b*' with loop elements 31*a*, 31*a*'. In conjunction with the latch assemblies 28, 28', the hook and loop fasteners 31, 31' prevent rotational movement of the back member 26 in the directions described by arrows 64, 65 (FIG. 5). It should be noted that other types of locking latches or catches could be substituted for the latch and receptacle members described above.

Referring to FIGS. 3A, 3B, 3C and 5, to fold down the back member 26 of the sofa 8, the arm members 38, 38' are pivoted outward and about side hinges 37, 37' away from back member 26 in a 180 degree arc through the position shown in FIG. 3B until resting in the position shown by FIG. 3C. The back member 26 is pivoted forward in the direction of arrow 62 (FIG. 4) towards the seat support unit 20 and about rear hinges 27.

In the assembled position, arm members 38, 38' and back member 26 are restricted in their inward and outward movements by the latching assemblies 28,28' and the hook and loop fasteners 31, 31'.

As seen in FIG. 1, the seat support frame 2 is integrally connected to the back member 26 and the arm members 38, 38' via the rear hinges 27 and side 37, 37' respectively. As a result, none of the various components of the sofa 8 can become lost or separated when the sofa is in its folded storage position.

Referring to FIG. 2, when upholstered in the assembled position, and with seat and back cushions 34, 34' 36, 36' in place, all of the hardware, (i.e. hinges 27, 37, 37') latch assemblies 28, 28', and hook and loop fasteners 31, 31' are hidden from view.

Referring now to FIGS. 3A, 9 and 10, the sofa is illustrated in the unfolded assembled position. The sofa is not shown as being upholstered for clarity reasons. The back member 26 is pivoted so that the respective side surfaces 18*a*, 18*a*' of back left and right side support members 18, 18' are contiguous and parallel with inside surfaces 40*a*, 40*a*' of rear arm frames 40, 40' forming pitch angle 62*a*. This pitch angle is determined by lining up the rear surfaces 18*c*, 18*c*' of back side support members 18, 18' parallel to the rear surfaces 40*e*, 40*e*' of the rear arm frame members 40, 40'. The pitch angle is fixed rigidly by locking latching assemblies 28, 28' as described above.

Figure 11:
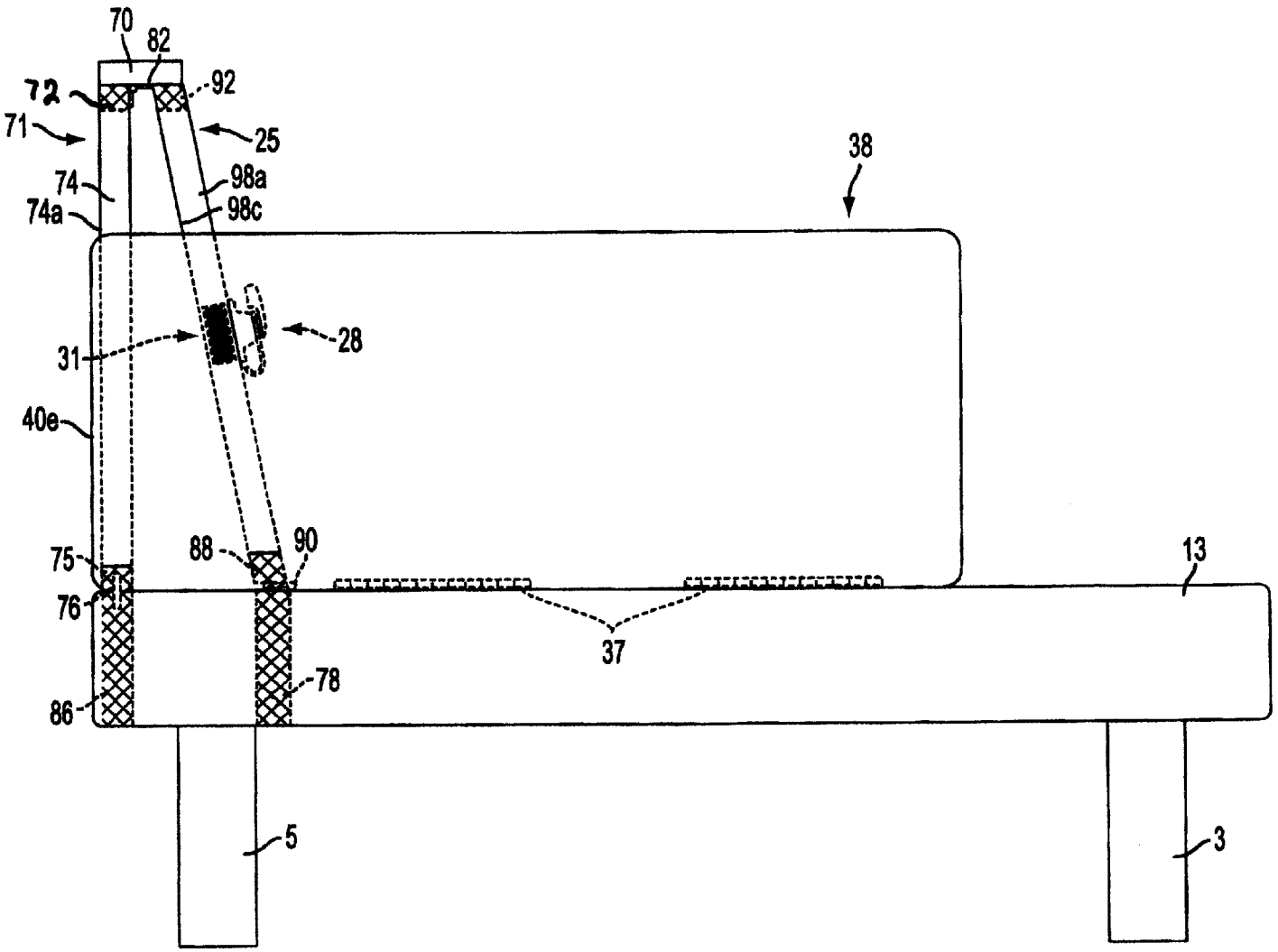
FIG. 11 is a side view of a second embodiment of the invention in the unfolded seating configuration.
Figure 12:
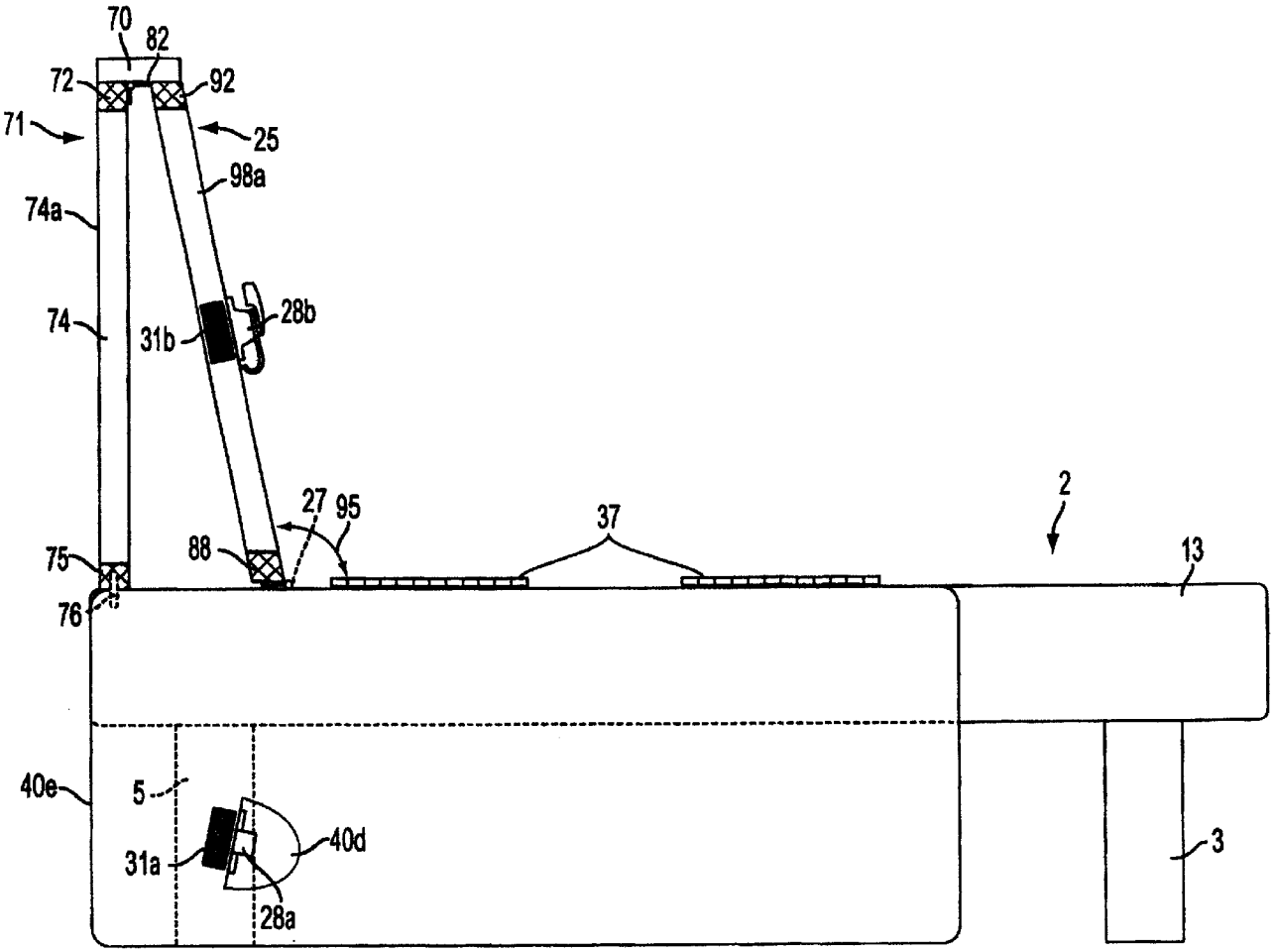
FIG. 12 is a side view of the second embodiment of the invention in a partially folded configuration.
Figure 13:
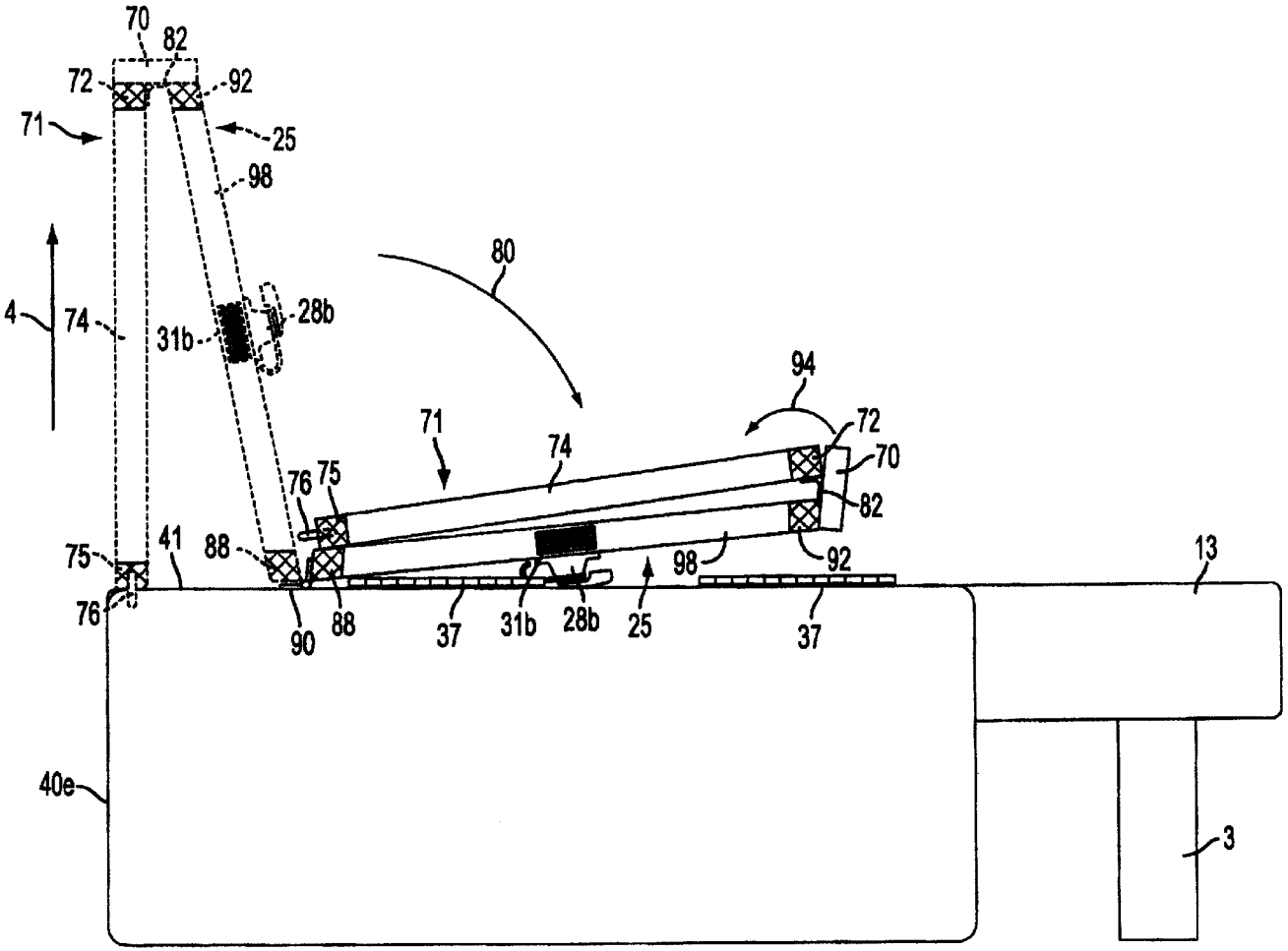
FIG. 13 is a side view of the second embodiment of the invention in the folded, storage or shipping configuration.

A second embodiment of the invention is illustrated in FIGS. 11, 12 and 13. This embodiment has a back part 25 consisting of a bottom back frame part 88, left and right side support back parts 98, 98', and a top back part 92. A pitch rail 78 is also provided which runs parallel to a rear support part 86 and is attached to bottom back frame part 88 by means of hinges 90.

An outer back part 71 is provided and is comprised of top outer back frame part 72, bottom outer back frame part 75, and outer back side support parts 74, 74'. Rear support part 86 is removably attached by means of dowels 76 or other removable attachment means, to bottom outer back frame part 75. Top back part 92 of back part 25 is connected to top outer back frame part 72 by means of a plurality of hinges 82 (or a continuous hinge). A top frame part 70 is also shown in this embodiment attached to outer back side support parts 74, 74' and back part 25. In this embodiment, hinges 82 are shown attached to top outer back frame part 72 and top frame part 70.

In the second embodiment of the invention (FIGS. 11, 12 and 13), the pitch angle 95 (FIG. 12) is determined by the relationship of back part 25 to outer back part 71. In the assembled position (FIG. 11), rear surfaces 40*e*, 40*e*' of the rear arm frames 40, 40' are now parallel with rear surfaces 74*a*, 74*a*' of outer back side support parts 74, 74'. As in the first embodiment, the pitch angle 95 (FIG. 12) is fixed rigidly by locking latching assemblies 28, 28'.

As shown in FIG. 12 and FIGS. 3A, 3B and 3C, arm members 38, 38' are pivoted outward and about side hinges 37, 37' away from back part 25 in a 180 degree arc through the position shown in FIG. 3B until resting in the folded storage position shown by FIGS. 3C and 12.

Referring to FIG. 13, the outer back side support parts 74, 74' are lifted up in the direction of arrow 84 so that dowels 76 are retracted from rear support frame member 11. (See FIG. 11.) Outer back side support parts 74, 74' are then pivoted around hinges 82 in the direction of arrow 94 until bottom outer back frame part 75 touches bottom back frame part 88. Back frame part 25 is then pivoted around hinges 90 in the direction of arrow 80 until back frame part 25 is contiguous with seat support frame 2.

Figure 14:
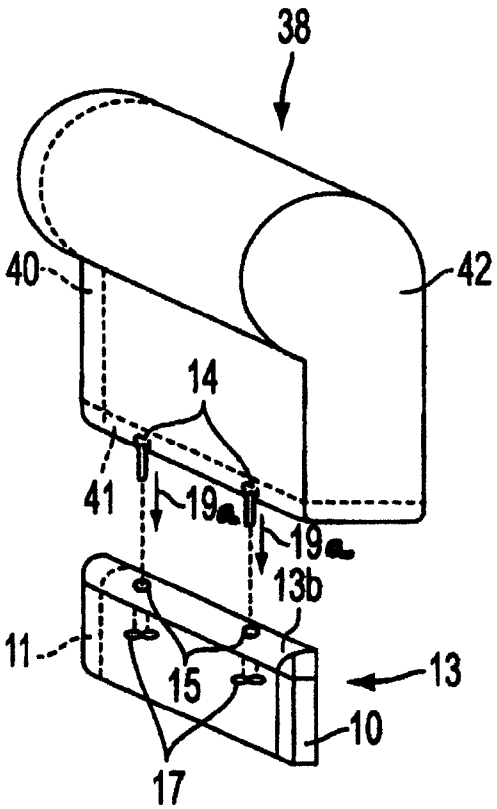
FIG. 14 is a perspective illustration of a third embodiment of the invention showing a modified left arm member attachment to the left side of a seating platform.

The left side of a third embodiment of the invention, having modified arm attachments, is shown in FIG. 14. In this third embodiment, bolts 14, 14' are attached to lower arm frames 41, 41' of arm members 38, 38'. In the assembly process, bolts 14, 14' are inserted through holes 15, 15' in the side support frame member 13, 13' and secured thereto by wing nuts 17, 17' (or other suitable fasteners). This third embodiment allows the arm members 38, 38' to be completely removed from seat support frame 2, if desired, for storage and shipping. In this embodiment, the hook and loop fasteners may be omitted.

Figure 15:
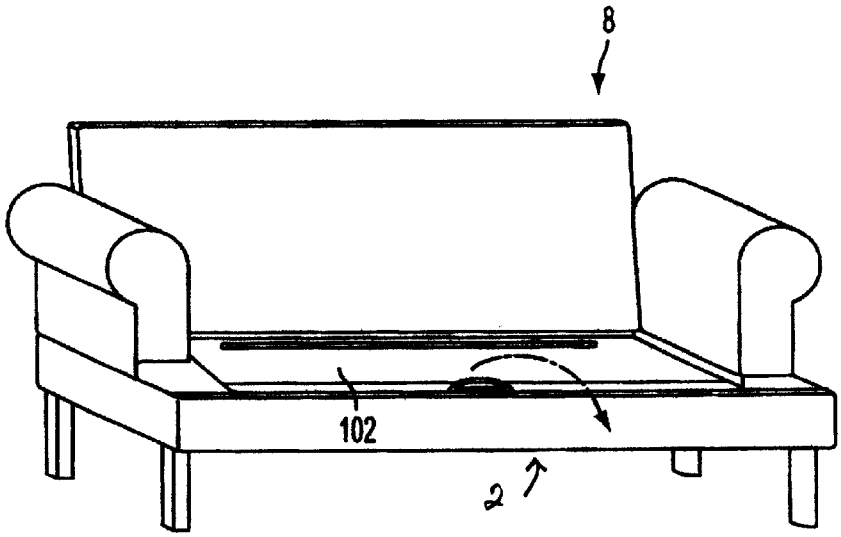
FIG. 15 is a front view of a fourth embodiment of the invention with the seat cushion and back cushion removed, and with a sleeper mechanism and mattress installed.
Figure 16:
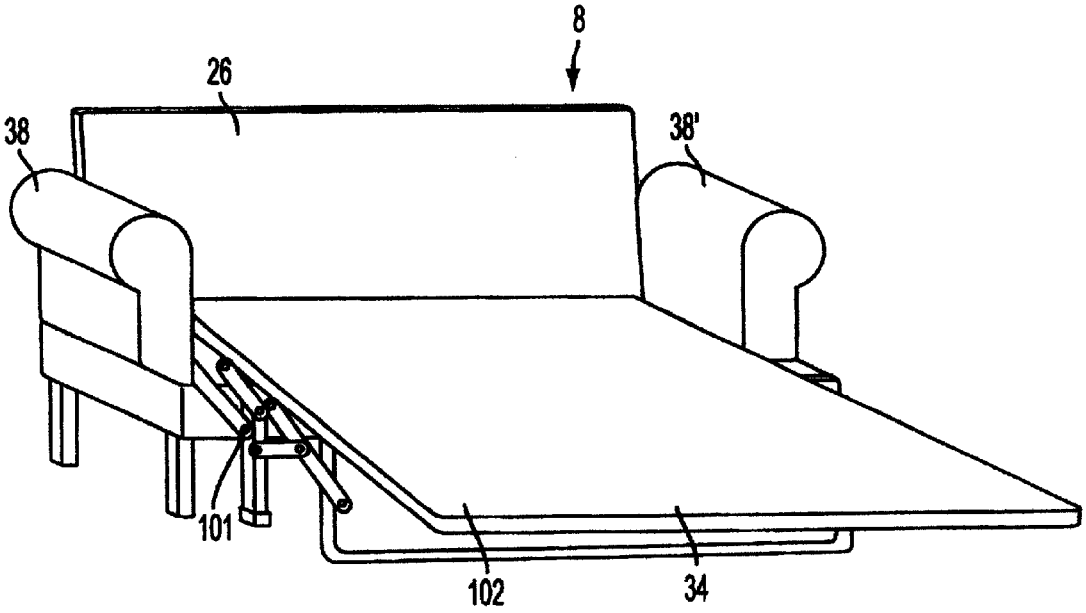
FIG. 16 is a perspective front view of the fourth embodiment of the invention with the sleeper mechanism and mattress unfolded.

A fourth embodiment is shown in FIGS. 15 and 16. In this embodiment, the seat support unit 20 (FIG. 1) has been replaced with a sleeper mechanism 101 and mattress 102. The sleeper mechanism and mattress may be generic units such as those manufactured by Leggett & Platt.

The sofa described in the first embodiment can have a width of about 82 inches, with a depth of the seat member 14 being about 34 inches and a height of the back member 26 being about 34 inches (from the floor) or 23 inches (as measured from the upper surface of the seat member). Further, the front support frame member 10 and the rear support frame member 11 can have a height of 11 inches. These particular dimensions provide a sofa that is comfortable for use and that is suitable, when upholstered and provided with cushions 34, 34', 36, 36' for the interior of most homes. Moreover, such a configured frame accommodates cushions having sufficient loft so as to provide the needed comfort level and also has sufficient storage space beneath seat support unit 20 to accommodate cushions 34, 34', 36, 36' in the unassembled storage position. (See FIG. 4.) Of course, other dimensions for the various support members and seat member can be used, so as to provide a sofa 8 having a different size, or a loveseat, chair or sleep sofa.

When the sofa frame is in the folded configuration for storage and shipping, (FIG. 4) the sofa 8 will have a foot print defined by the support frame members 10, 11, 13, 13' plus the surfaces defined by bottom arm surfaces 40*c*, 40*c* of rear arm frames 40, 40', for example 89 inches wide by 29 inches in depth for the sofa 8 described above. The folded sofa has a substantially decreased depth as compared with its assembled state. This is because the top back member 16 of back member 26 is pitched back beyond the perpendicular of the rear support frame member 11 in the unfolded seating position. When folded, however, the bottom back member 12 of back member 26 is contiguous and parallel to the rear edge of rear support frame member 11 (FIG. 10). A folded sofa 8, when provided with the seat cushions 34, 34', and back cushions 36, 36' can be stored and transported in a carton (not shown) having a width of 80 inches, a depth of 31 inches, and a height of only 25 inches. This is 40% less than the volume of the carton necessary to transport and store the sofa 8 in its unfolded state.

When it is desired to minimize the size of the carton needed to transport the sofa, the third embodiment shown in FIG. 14 may be utilized. With this embodiment, the foot print is defined by only the support frame members and is 68 inches wide by 31 inches deep and 28 inches in height.

Any of the first, second and third embodiments can be combined with a sleeper mechanism 101 to provide the fourth embodiment of the invention shown in FIGS. 15 and 16. In these cases, the sleeper mechanisms could be shipped separately from the remainder of the sofa.

The various support members and seat member are preferably comprised of wood, for example, solid wood or plywood. Other materials, such as molded plastic or metal can also be used.

As will be appreciated, since the various members are essentially components that can be individually built and upholstered before being joined by the hinge members, this greatly facilitates the manufacture of the furniture item. While the present invention has been described in detail with respect to preferred embodiments, it will be understood that numerous modifications, changes, variations and equivalents may be made by those skilled in the art without departing from the spirit and scope of the invention. Accordingly, it is intended that the invention herein be limited only by the scope of the appended claims.

We claim:

1. An upholstered foldable furniture system for mounting on a substantially horizontal surface, said furniture system having a first assembled configuration for seating; and a second unassembled configuration for storage and shipping, comprising:

a horizontal seat support frame having front and rear support frame members, and spaced left and right side support frame members, said seat support frame supporting a a seat support unit;

a back member, having left and right back side support members and a bottom back member, said bottom back member being rotatably secured to said rear support frame member, said back member being rotatable between a position substantially parallel to said horizontal seat support frame and an angle of not less than 90° with respect to said horizontal seat support frame;

left and right arm members, each of said left and right arm members having a rear arm frame, and a lower arm frame, said left and right lower arm frames being secured to said left and right side support frame members respectively for rotation of said arm members through 180° from the first configuration for seating to the second configuration for storage and shipping; and left and right latch assemblies, each of said left and right latch assemblies having a first part and a second part, the first part of said left latch assembly being attached to one of said left arm member and said left back side support member, and the second part of said left latch assembly being attached to the other of said left arm member and said left back side support member; and the first part of said right latch assembly being attached to one of said right arm member and said right side back side support member, and the second part of said right latch assembly being attached to the other of said right arm member and said right back side support member, whereby when the furniture system is in the first assembled configuration for seating, said back member is in a substantially vertical position making an angle of not less than 90° with respect to the seat support frame, said left and right arm members are in substantially vertically upward positions, and the first and second parts of said left and right latch assemblies are latched, and when the furniture system is in the second configuration for storage and shipping said back member is in a substantially horizontal position, and said first and second parts of said left and right latch assemblies are unlatched.

2. The upholstered foldable furniture system defined by claim 1 which further comprises a rear hinge, having a first horizontal axis of rotation, interposed between said bottom back member and said rear support frame member, said back member being rotatable about said first horizontal axis.

3. The upholstered foldable furniture system defined by claim 2 which further comprises left and right side hinges, each of said side hinges having a second horizontal axis and being interposed between one of said left and right arm members and a corresponding one of said left and right side support frame members, each of said arm members being rotatable about one of said second horizontal axes.

4. The upholstered foldable furniture system defined by claim 2 wherein the left and right lower arm frames of said left and right arm members are secured by bolts to said left and right side support frame members.

5. The upholstered foldable furniture system defined by claim 1 wherein a sleeper unit is located within said horizontal seat support frame and attached to at least one of said front and rear support frame members and said side support frame members.

6. An upholstered foldable furniture system for mounting on a substantially horizontal surface, said furniture system having a first unfolded configuration for seating; and a second folded configuration for storage and shipping, comprising:

a horizontal seat support frame having front and rear support frame members, and spaced left and right side support frame members, said seat support frame supporting a a seat support unit;

a back member, having left and right back side support members and a bottom back member, said bottom back member being rotatably secured to said rear support frame member, said back member being rotatable between a position substantially parallel to said horizontal seat support frame and an angle of not less than 90° with respect to said horizontal seat support frame;

left and right arm members, each of said left and right arm members having a rear arm frame and a lower arm frame, said left and right lower arm frames being rotatably secured to said left and right side support members respectively for rotating each of said left and right arms from a vertically upward position to a vertically downward position; and left and right latch assemblies, each of said left and right latch assemblies having a first part and a second part, the first part of said left latch assembly being attached to one of said left arm member and said left back side support member, and the second part of said latch assembly being attached to the other of said left arm member and said left back side support member; and the first part of said right latch assembly being attached to one of said right arm member and said right back side support member, and the second part of said latch assembly being attached to the other of said right arm member and said back right side support member, whereby when the furniture system is in the first unfolded configuration for seating said back member at an obtuse angle relative to said side support frame members, said left and right arm members are in vertically upward positions, and first and second parts of said left and right latch assemblies are latched, and when said furniture system is in the second folded configuration for storage and shipping said back member is in a substantially horizontal position, said left and right arm members are in a vertically downward position, and said first and second parts of said left and right latch assemblies are unlatched.

7. The upholstered foldable furniture system defined by claim 6 which further comprises left and right side hinges, each of said side hinges having a second horizontal axis and being interposed between one of said left and right arm members and a corresponding one of said left and right side support frame members, each of said arm members being rotatable about one of said second horizontal axes.

8. The upholstered foldable furniture system defined by claim 6 wherein a sleeper unit is located within said horizontal seat support frame and attached to at least one of said front and rear support frame members and said side support frame members.

9. The upholstered foldable furniture system defined by claim 6 which further comprises left and right fasteners, each of said fasteners having a hook element and a loop element, said hook element being connected to one of said left arm member and said left back side support member, and said loop element being connected to the other of said left arm member and said left back side support member; and said hook element being connected to one of said right arm member and said right back side support member, and said loop element being connected to the other of said right arm member and said right back side support member, said fasteners cooperating with said latch assemblies to prevent rotational movement of said back member about said rear support frame member.

10. An upholstered foldable furniture system for mounting on a substantially horizontal surface, said furniture system having a first unfolded configuration for seating and a second folded configuration for storage and shipping, comprising:

a horizontal seat support frame, said seat support frame having a front support frame member;

a rear support frame member spaced from said front support frame member; and left and right spaced side support frame members interposed between said front and rear support frame members;

a back member, said back member having a bottom back member rotatably secured to said rear support frame member, said back member being rotatable between a position substantially parallel to said horizontal seat support frame and an obtuse angle relative to said back member;

a top back member spaced from said bottom back member; and left and right back side support members interposed between said bottom and top back members;

left and right arm members, each of said left and right arm members having a front arm frame;

a rear arm frame spaced from said front arm frame;

a lower arm frame interposed between said front and rear arm frames; and an upper arm frame interposed between said front and rear arm frames and spaced from said lower arm frame, said left and right lower arm frames being rotatably secured to said left and right side support frame members respectively for rotating each of said arm members between a vertically upward position and a vertically downward position; and left and right latch assemblies, each of said left and right latch assemblies having a latch member; and a latch receptacle, engageable with said latch member, said latch member of said left latch assembly being secured to one of said left rear arm frame and a surface of said left back side support member, and said latch receptacle of said left latch assembly being secured to the other of said left rear arm frame and a surface of said left back side support member; and said latch member of said right latch assembly being secured to one of said right rear arm frame and a surface of said right back side support member, and said latch receptacle of said right latch assembly being secured to the other of said right rear arm frame and a surface of said right back side support member; whereby when said furniture system is in the first unfolded configuration for seating, said back member is at an obtuse angle relative to said side support frame members; said arm members are in a vertically upward position, and said latch members and said latch receptacle members are latched, and when said furniture system is in the second folded configuration for storage and shipping said back member is in a substantially horizontal position, said arm members are in a vertically downward position, and said latch members and said latch receptacle members are unlatched.

11. The upholstered foldable furniture system defined by claim 10 which further comprises a rear hinge, having a first horizontal axis of rotation, interposed between said bottom back member and said rear support frame member, said back member being rotatable about said first horizontal axis.

12. The upholstered foldable furniture system defined by claim 10 which further comprises left and right side hinges, each of said side hinges having a second horizontal axis and being interposed between one of said left and right arm members and a corresponding one of said left and right side support frame members, each of said arm members being rotatable about one of said second horizontal axes.

13. The upholstered foldable furniture system defined by claim 10 wherein a sleeper unit is located within said horizontal seat support frame and attached to at least one of said front and rear support frame members and said side support frame members.

14. The upholstered foldable furniture system defined by claim 10 which further comprises left and right fasteners, each of said fasteners having a hook element and a loop element, said hook element being connected to one of said left arm member and said left back side support member, and said loop element being connected to the other of said left arm member and said left back side support member; and said hook element being connected to one of said right arm member and said right back side support member, and said loop element being connected to the other of said right arm member and said right back side support member, said fasteners cooperating with said latch assemblies to prevent rotational movement of said back member about said rear support frame member.

15. An upholstered foldable furniture system for mounting on a substantially horizontal surface, said furniture system having a first unfolded configuration for seating and a second folded configuration for storage and shipping, comprising:

a horizontal seat support frame, said seat support frame having a front support frame member;

a rear support part spaced from said front support frame member; and a pitch rail interposed between said rear support part and said front support member;

left and right spaced side support frame members interposed between said front support members and said rear support part, said side support frame members being attached to said pitch rail;

a back part, said back part having a bottom back part rotatably secured to said pitch rail, said back part being rotatable between a position parallel to said horizontal seat support frame and an angle of not less than 90° relative to said seat support frame; and a top back part spaced from said bottom back part; and left and right side support back parts interposed between said bottom and top back parts;

an outer back part, said outer back part having a bottom outer back frame part removably attached to said rear seat support part;

a top outer back frame part spaced from said bottom outer back frame part; and left and right outer back side support parts interposed between said bottom and top back frame parts;

a top frame part attached to said back part and rotatably joined to said top outer back part frame part;

left and right arm members, each of said left and right arm members having a front arm frame;

a rear arm frame spaced from said front arm frame;

a lower arm frame interposed between said front and rear arm frames; and an upper arm frame interposed between said front and rear arm frames and spaced from said lower arm frame, said left and right lower arm frames being rotatably secured to said left and right side support frame members respectively for rotating each of said arm members between a vertically upward position and a vertically downward position; and left and right latch assemblies, each of said left and right latch assemblies having a latch member; and a latch receptacle, engageable with said latch member, said latch member of said left latch assembly being secured to one of said left rear arm frame and a surface of said left side support back part, and said latch receptacle of said left latch assembly being secured to the other of said left rear arm frame and the surface of said left side support back part; and said latch member of said right latch assembly being secured to one of said right rear arm frame and a surface of said right side support back part, and said latch receptacle of said right latch assembly being secured to the other of said right rear arm frame and a surface of said right side support back part; whereby when said furniture system is in the first unfolded configuration for seating said back part is at an obtuse angle relative to said side support members; and the arm members are in a vertically upward position relative to said side support members; and said latch members and said latch receptacles are latched, and when said furniture system is in the second folded configuration for storage and shipping said back member is in a substantially horizontal position, said arm members are in a vertically downward position, and said latch members and said latch receptacles are unlatched.

16. The upholstered foldable furniture system defined by claim 15 which further comprises a rear hinge, having a first horizontal axis of rotation, interposed between said bottom back member and said rear support frame member, said back member being rotatable about said first horizontal axis.

17. The upholstered foldable furniture system defined by claim 16 which further comprises left and right side hinges, each of said side hinges having a second horizontal axis and being interposed between one of said left and right arm members and a corresponding one of said left and right side support frame members, each of said arm members being rotatable about one of said second horizontal axes.

18. The upholstered foldable furniture system defined by claim 16 wherein the left and right lower arm frames of said left and right arm members are secured by bolts to said left and right side support frame members.

19. The upholstered foldable furniture system defined by claim 15 wherein a sleeper unit is located within said horizontal seat support frame and attached to at least one of said front and rear support frame members and said side support frame members.

20. The upholstered foldable furniture system defined by claim 15 which further comprises left and right fasteners, each of said fasteners having a hook element and a loop element, said hook element being connected to one of said left arm member and said left back side support member, and said loop element being connected to the other of said left arm member and said left back side support member; and said hook element being connected to one of said right arm member and said right back side support member, and said loop element being connected to the other of said right arm member and said right back side support member, said fasteners cooperating with said latch assemblies to prevent rotational movement of said back member about said rear support frame member.

* * * * *